US007013490B2

(12) United States Patent
Senter et al.

(10) Patent No.: US 7,013,490 B2
(45) Date of Patent: Mar. 21, 2006

(54) ILLUMINATED GLOVE

(75) Inventors: Robert L. Senter, Castle Rock, CO (US); Robert E. Matuszewski, Castle Rock, CO (US)

(73) Assignee: Magna Products LLC, Englewood, CO (US)

( * ) Notice: Subject to any disclaimer, the term of this patent is extended or adjusted under 35 U.S.C. 154(b) by 142 days.

(21) Appl. No.: 10/602,269

(22) Filed: Jun. 23, 2003

(65) Prior Publication Data

US 2004/0255361 A1 Dec. 23, 2004

(51) Int. Cl.
*A41D 19/00* (2006.01)

(52) U.S. Cl. ..... 2/160

(58) Field of Classification Search ..... 2/160; 362/109, 570

See application file for complete search history.

(56) References Cited

U.S. PATENT DOCUMENTS 4,422,131 A * 12/1983 Clanton et al. ..... 362/186
5,177,467 A * 1/1993 Chung-Piao ..... 340/574
5,424,922 A * 6/1995 Wise ..... 362/554
5,535,105 A 7/1996 Koenen et al. ..... 362/103
5,580,154 A 12/1996 Coulter et al. ..... 362/103
5,879,076 A 3/1999 Cross ..... 362/555
5,898,942 A 5/1999 Anderson ..... 2/159
6,006,357 A * 12/1999 Mead ..... 2/160
6,709,142 B1 * 3/2004 Gyori ..... 362/554
6,711,746 B1 * 3/2004 Orellana ..... 2/160
2004/0037091 A1 * 2/2004 Guy ..... 362/582
2004/0128736 A1 * 7/2004 Raz et al. ..... 2/159

OTHER PUBLICATIONS

International Search Report, PCT/US04/18110, Mar. 14, 2005.

* cited by examiner

*Primary Examiner*—Katherine M. Moran
(74) *Attorney, Agent, or Firm*—Dorsey & Whitney LLP

(57) ABSTRACT

An illuminated glove having a light source that is switch activated between a continuous light mode, a blinking light mode or an off mode is readily visible in low light or no light conditions. The illumination source itself has a single light source that is utilized to become broadly illuminated through use of a polymer lens or light conducting fibers so that the illumination from the system is broadly distributed across the back palm side of the glove. The light source is activated either by a voice activated system, a single point dome switch or a double contact switch having the contacts located on the thumb and index finger so that the unit can be controlled by simply pressing the thumb against the index finger.

7 Claims, 7 Drawing Sheets

ILLUMINATED GLOVE

BACKGROUND OF THE INVENTION

1. Field of the Invention

The present invention relates to partial or full gloves on which are mounted a battery-operated light source that cooperates with a light transmitting medium to illuminate a relatively broad area with the light source. A single point contact switch or contact between two locations on the glove can be utilized for activating and deactivating the light source.

2. Description of the Relevant Art

It has long been known that individuals participating in outdoor activities in low light or dark conditions may be exposed to danger from vehicular traffic or the like. By way of example, construction road crews, police officers, firefighters, joggers, or even pedestrians can be exposed to injury when not seen. This, of course, is particularly true in low light conditions or at night, but can be true even in inclement weather conditions, such as snow storms and the like. Further, individuals participating in winter sports, such as skiing, snowboarding, sledding or the like may also be exposed to injury in inclement weather where vision is impaired.

While attempts have been made to provide means for making an individual more visible in such low light or dark conditions, they are less than satisfactory. For example, individuals participating in outdoor activities have placed reflective tapes on their clothing, worn bright-colored clothing, utilized reflective holograms, even surface-mounted beams of light and/or reflective or transmitting devices but as will be appreciated, unless a motorist's lights strike the reflective material precisely or the motorist can recognize or see a beam of light, the individuals remain at risk. Warning materials have even been incorporated into articles of clothing, such as reflective tape on gloves as disclosed in U.S. Pat. No. 5,898,942 issued to Anderson on May 4, 1999. Gloves have also been provided with illuminating substances having phosphorescence or florescent properties as evidenced by U.S. Pat. No. 5,580,154 issued to Coulter, et al. Gloves having illuminating beams are also known, even though they are more concerned with illuminating a work area than for safety purposes. An example of such a glove with a light source mounted thereon is disclosed in U.S. Pat. No. 5,535,105 issued to Koenen, et al.

Light sources which are broader in scope and possibly more visible than a single beam of light are also known in the art such as is disclosed in U.S. Pat. No. 5,879,076 issued to Cross on Mar. 9, 1999, even though these light sources have not been incorporated into gloves, but rather into belts or the like, and are relatively expensive to manufacture and not easily operated without utilizing ones hands in a manner that renders the hands unavailable for other uses such as operating a motorcycle, riding a bicycle, participating in manual labor requiring the hands, and the like. As will be appreciated, in the device disclosed in the aforenoted patent to Cross, a light source is embedded in a thermoplastic material which will spread the light over a relatively broad surface.

It is to provide a system for optimally illuminating individuals participating in outdoor activities under low light, no light or inclement weather conditions and to overcome the shortcomings in prior art systems that the present invention has been developed.

SUMMARY OF THE INVENTION

The present invention relates generally to a partial or full glove that can be worn by individuals participating in low light or no light conditions, or even in conditions of inclement weather where visibility is restricted, to readily indicate the individual's presence. As will be appreciated from the detailed description set forth hereinafter, the system allows an individual to continue his or her activities uninhibited while making himself or herself readily visible in low visibility environments.

The glove includes a light source positioned adjacent to a light conducting material such as light conducting fibers, thermoplastics, translucent polymer lenses or the like so that the light from the light source is transmitted over a broader area for better visibility. The light source is mounted with a battery and a switch system for energizing the light source, so that it is operable in three different modes, namely, on, off and blinking. A single contact or dome switch adjacent to the light source might be used or a two point contact switch might be positioned at two locations on the glove so that they can be simply and selectively moved into electrical contact as desired.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
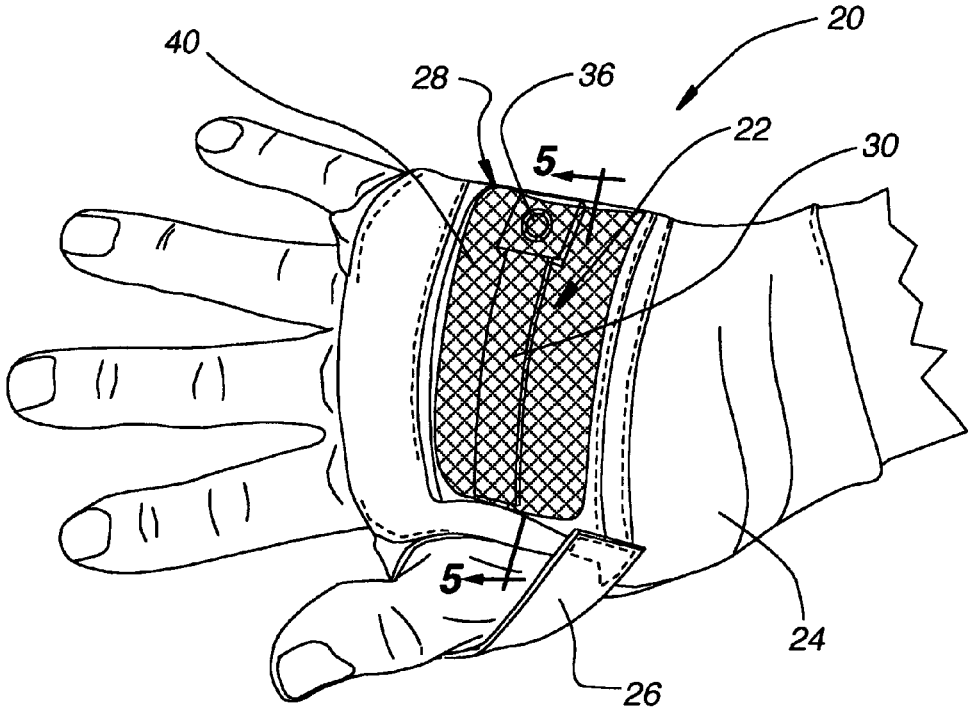
FIG. 1 is a fragmentary top plan view of a partial glove mounted on the hand of a user with one embodiment of an illuminating system mounted on the glove.

FIGS. 1 and 5–9 illustrate one embodiment of a glove 20 incorporating a light illumination system 22 in accordance with the present invention, with the glove being a half glove wherein it includes an enclosure 24 that surrounds only the palm portion of a user's hand. A releasable thumb strap 26 passes around the thumb of the user to hold the glove in place. On the back side of the glove, which might be made of any flexible fabric, leather or like material, a pocket 28 is provided in the glove material for receipt of the light illumination system 22. In the embodiment of the glove illustrated in FIG. 1, the light illumination system is an elongated lens 30 formed from a strip of a translucent polymer and a light source 32 positioned contiguous with the end of the lens as is best seen in FIGS. 6–9. The light source could be embedded in the lens but it is preferable that it be positioned contiguous with the lens for economic purposes. The light source with the translucent polymer lens is integrated with a battery 34, pressure switch 36 and electrical circuitry on a circuit board 37 for energizing and de-energizing the light source. The light source could be any one of a number of known sources such as a light emitting diode, preferably of a red color, an infrared emitting diode, a light bulb or any other suitable source of light. The particular light source utilized is not critical even though the red light emitting diode and infrared emitting diode have been found to be particularly suitable for use in the glove of the present invention.

The translucent polymer lens 30 is known to disperse light from a light source positioned adjacent thereto so as to illuminate the lens along its length. Other materials may also be used such as a thermoplastic polymer lens, reflective translucent plastic or light conductive fibers utilized in a manner to be described later. An example of a lens material is a material marketed by Dupont Dow as "Engage" under Product No. 8842.

The battery 34, pressure switch 36 and light source 32 are preferably integrated into a base unit which is subsequently secured to the end of the elongated translucent polymer lens 30 such that light is directed longitudinally along the length of the polymer lens. Such a lens is known to transmit and redistribute light emitted along its length. In other words, the light source 32 is contiguous with one end of the polymer lens and is secured thereto with a shrinkable plastic sleeve 38, tape or the like, so that the battery and pressure switch with incorporated circuitry are longitudinally aligned with the polymer lens defining a relatively thin elongated unit. The light illuminating system may be confined in the glove beneath a transparent or translucent flexible layer 40 of plastic, fabric or the like and within the pocket 28 which is defined by the plastic or fabric cover and the glove enclosure 24 itself.

Figure 11:
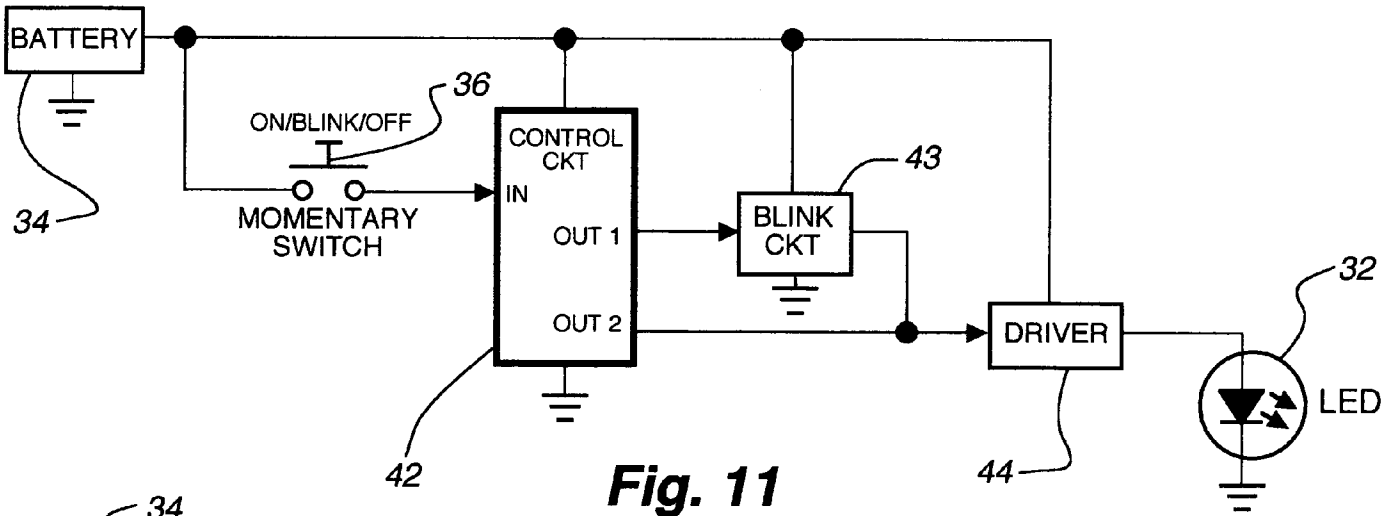
FIG. 11 is a block diagram illustrating the circuitry used in the glove of FIG. 1.

The circuitry diagram for the light illumination system 22 is shown in FIG. 11 in block form where it will be seen that the battery 34 is connected to a momentary pressure switch 36 that in turn operates a control circuit 42 having three modes, (a) "on-continuous," (b) "on-blinking" or (c) "off." The control circuit in the "on-blinking" mode energizes a blink circuit 43 which causes the light source 32 to go on and off at a predetermined rate through a driver 44 connected to the light source. In the "on-continuous" mode, a continuous current is delivered through the driver to the light source. Of course in the "off" mode, the control circuit is not energized at all. The switch preferably is a momentary switch so that one needs to hold it down for a predetermined time before it is operative, thus preventing the light from being inadvertently turned on or off by accidentally touching the switch.

FIGS. 2, 10, 13 and 14 illustrate a second embodiment 46 of the present invention wherein a full glove carries a light illuminating system 48 on the back of the palm thereof. This light illuminating system is comprised of a battery 50 with a remote double contact switch 52 for operation thereof, and wherein a plurality of optical fibers 54 are confined within a plastic or rubber body 56 that holds them in place. Each of the optical fibers has one end 58 positioned at one end of the plastic or rubber body 56 adjacent to a light source 60 while the opposite ends 62 of the fibers are turned upwardly so as to be exposed perpendicularly away from the back palm surface of the glove. The battery and light source would again be confined in a modular unit, but the contact switch for operating the light source has two contacts 64 and 66 which are at remote locations, for example on the inside of the thumb and index finger sleeves respectively of the glove. The illuminating system can be operated simply by touching the contacts 64 and 66 of the switch together when squeezing the thumb against the index finger. The plastic or rubber body 56 could be confined to the glove enclosure in any suitable manner, which might again be in a pocket defined beneath a transparent plastic or fabric cover 68 as used in FIG. 1, or the body 56 itself might simply be bonded or otherwise secured to the outer surface of the glove on the back of the palm thereof. This embodiment of the invention is particularly desirable when the hands are needed for other purposes so that the illuminating system can be energized or de-energized simply by moving the thumb into engagement with the index finger, whereas in the embodiment of FIG. 1, for example, the opposite hand would have to be used to press the pressure switch 36 to activate the system.

Figure 2:
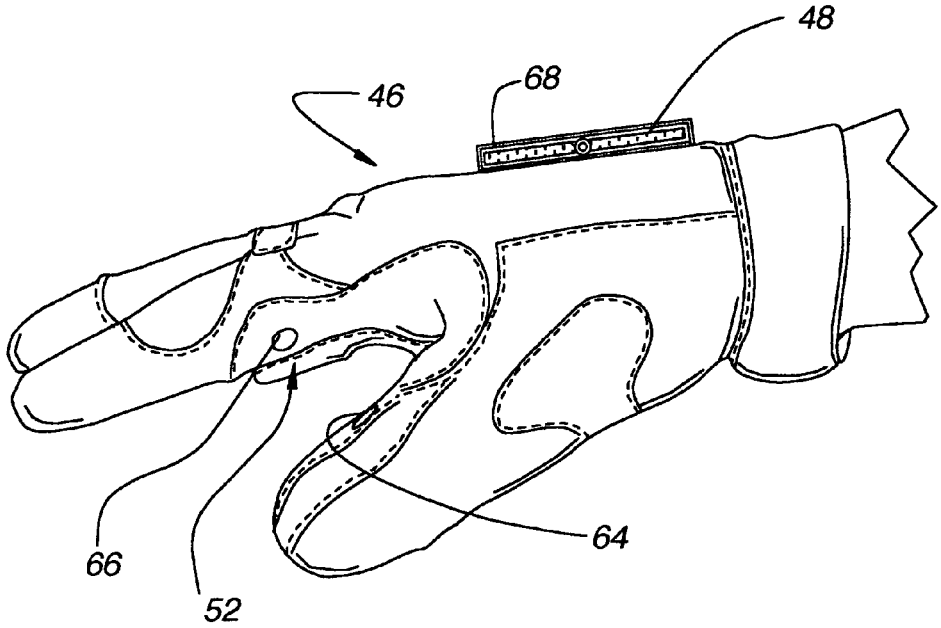
FIG. 2 is a fragmentary side elevation of a full glove having a light illuminating system in accordance with the present invention and a double contact switch for operating the light illuminating system.

The circuitry associated with the embodiment of FIG. 2 is not illustrated but would be similar to that described previously in FIG. 11, except that the momentary switch would be replaced with the double contact switch 52.

Figure 12:
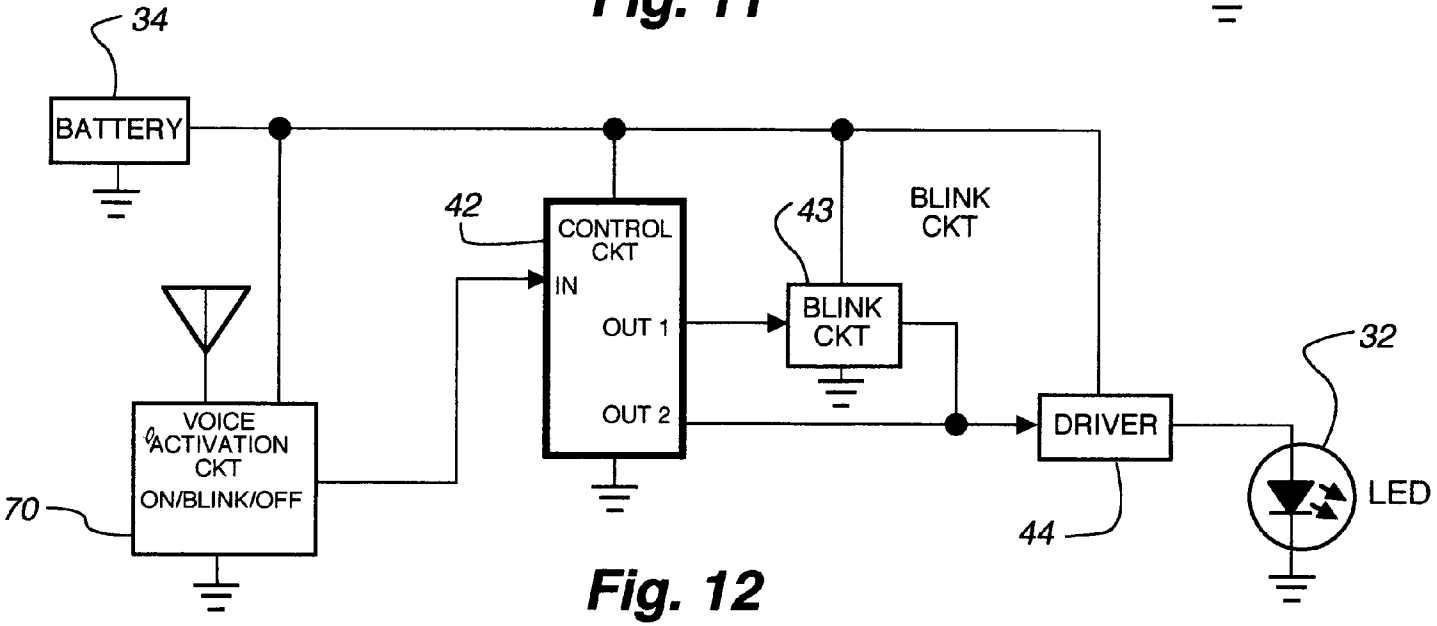
FIG. 12 is a block diagram illustrating the circuitry used in the glove of FIG. 2.
Figure 13:
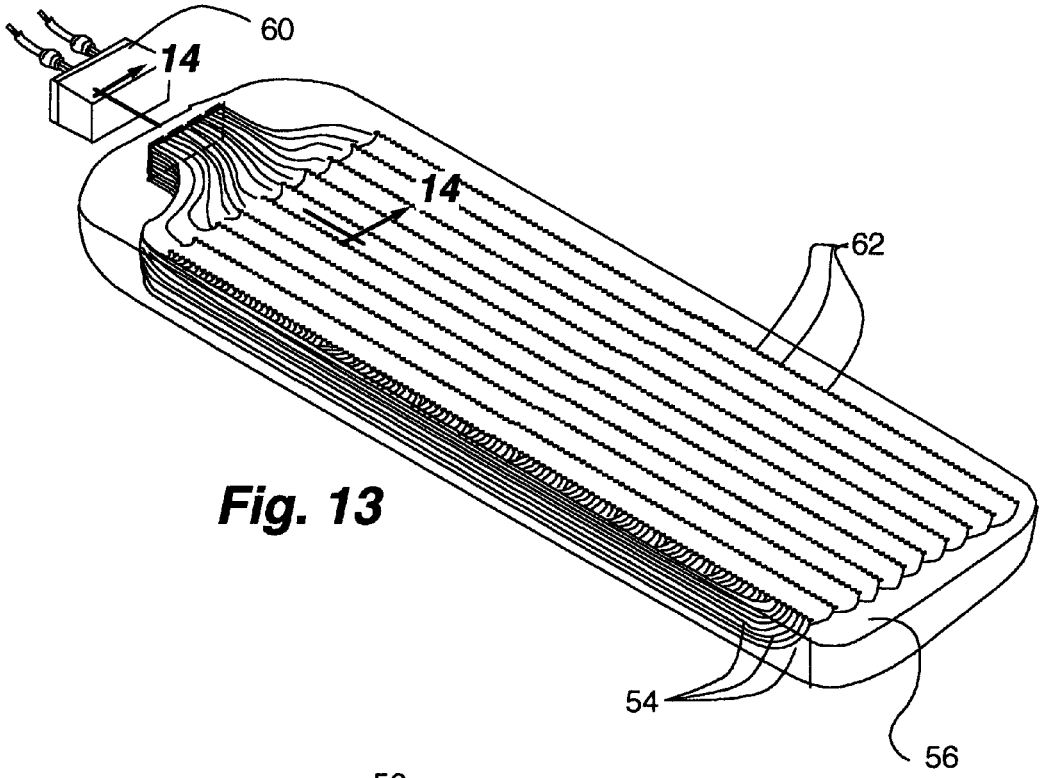
FIG. 13 is an isometric view of an alternative embodiment of an illuminating system utilizing optical fibers.
Figure 14:
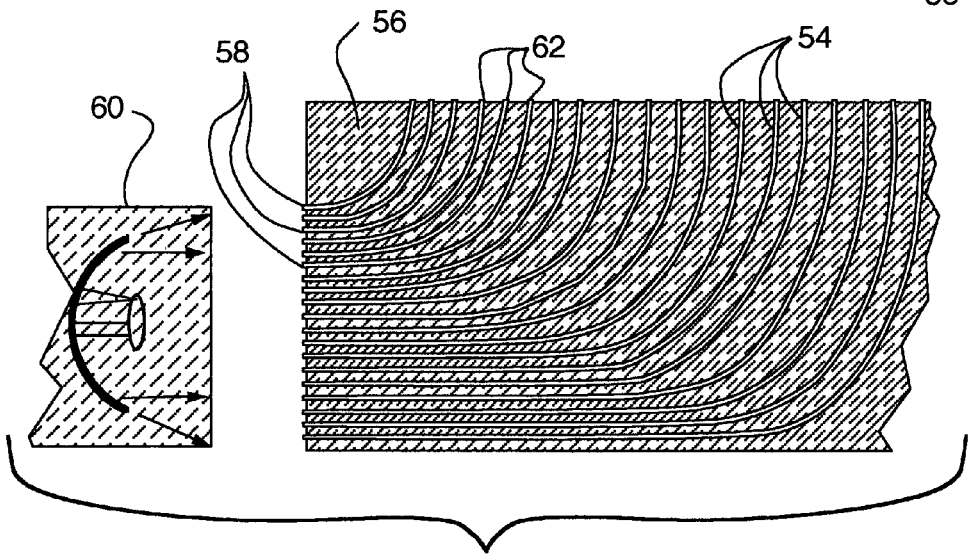
FIG. 14 is an enlarged section taken along line 14—14 of FIG. 13.

As an option to the circuit shown in FIG. 11 for either the momentary switch 36 or the double contact switch 52, a conventional voice activation unit 70 could be utilized which is responsive to voice commands such as "on", "blink" or "off". This circuit is illustrated in FIG. 12 with the circuit including the identical elements of FIG. 11 which have been given like reference numerals except that the switch is replaced with the voice activation unit.

Figure 3:
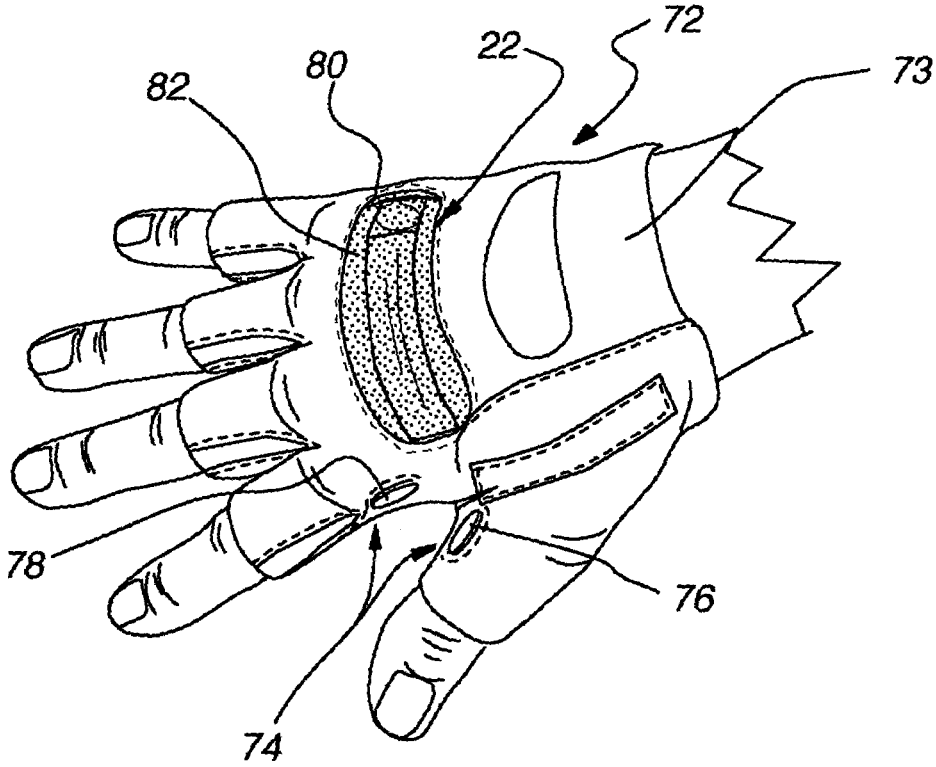
FIG. 3 is a fragmentary top plan view of a glove with partial fingers utilizing the switch and light illuminating system of FIG. 2.

FIG. 3 illustrates still another embodiment of the present invention wherein a partial fingered glove 72 is illustrated having an enclosure 73 that surrounds the palm of the hand as well as a portion of the thumb and the four fingers. This embodiment is again operated with a double contact switch 74 having the contacts 76 and 78 on the inside of the sleeves for the thumb and the index finger respectively for easy operation of the system. In this glove, the illumination system 22 described in connection with FIG. 1 is confined in a pocket 80 formed on the glove between an outer reflective translucent plastic sheet of material 82 or the like and the underlying surface of the glove enclosure 73.

Figure 4:
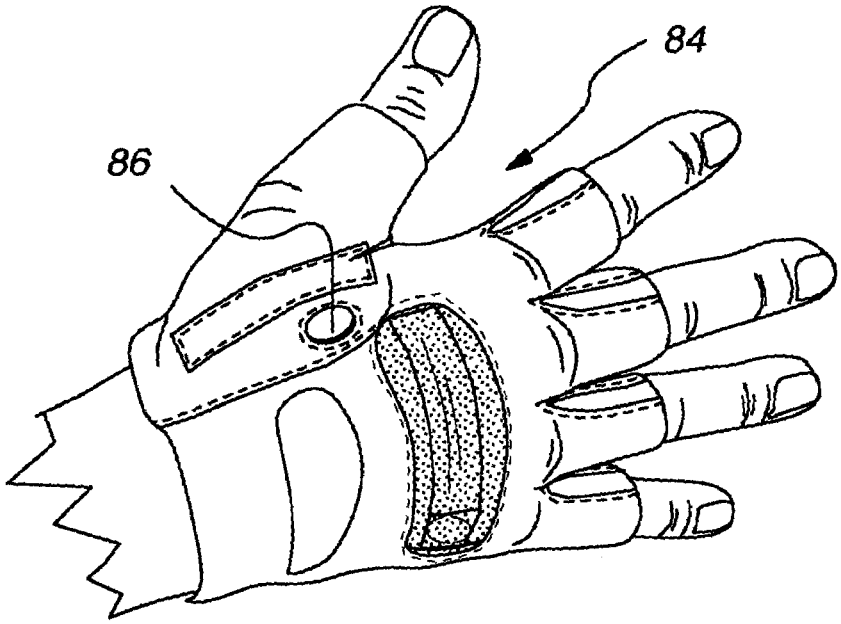
FIG. 4 is a fragmentary top plan view similar to FIG. 3 with a single point pressure switch for operating the light illuminating system.
Figure 5:
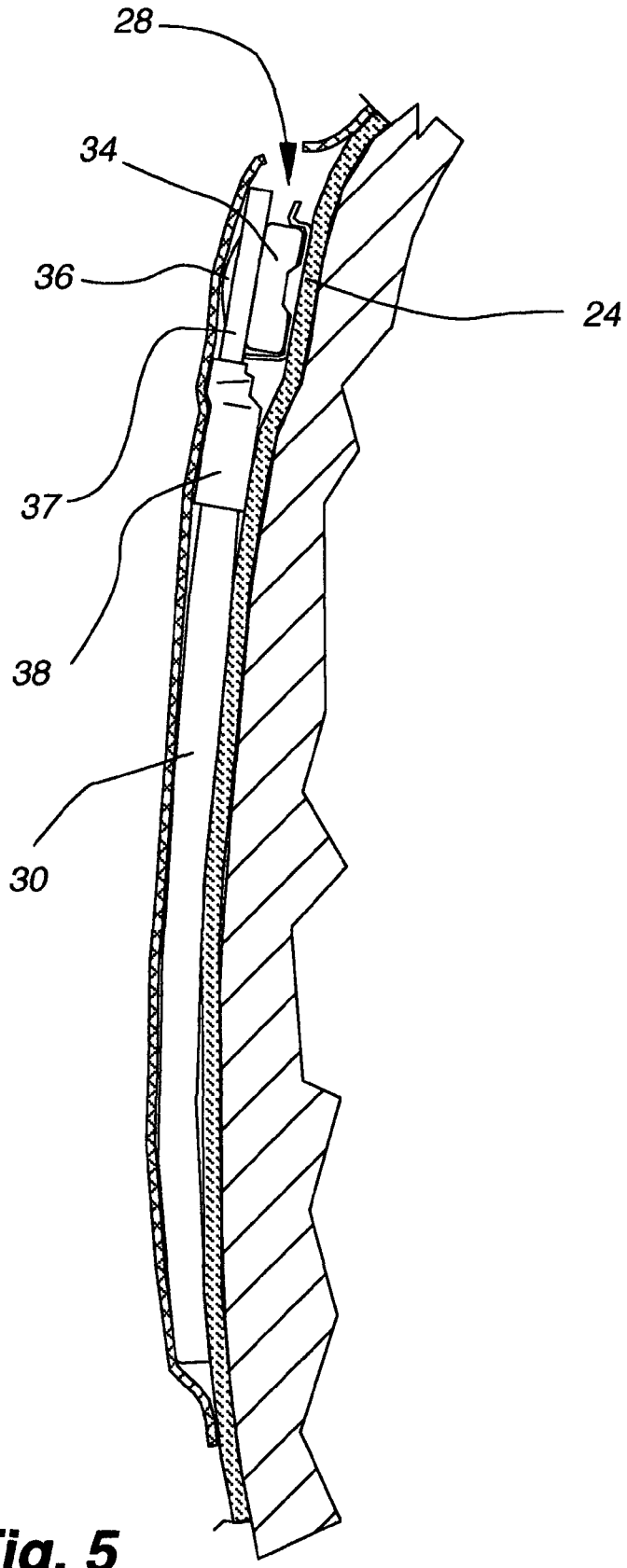
FIG. 5 is an enlarged fragmentary section taken along line 5—5 of FIG. 1.
Figure 6:
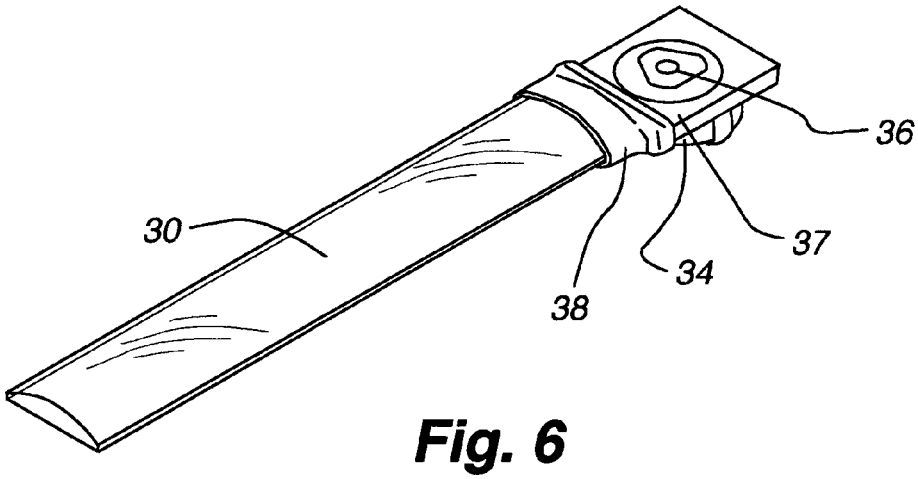
FIG. 6 is an isometric view of the light illuminating system utilized in the glove of FIG. 1.
Figure 7:
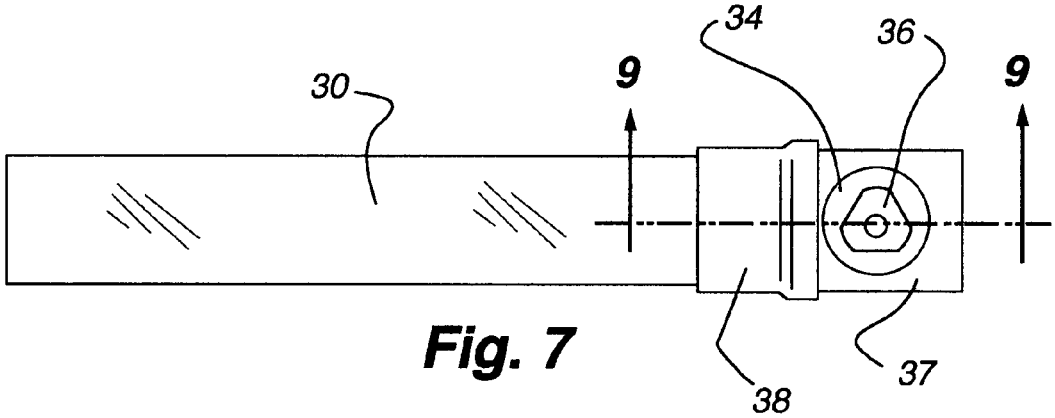
FIG. 7 is a top plan view of the light illuminating system shown in FIG. 6.
Figure 8:
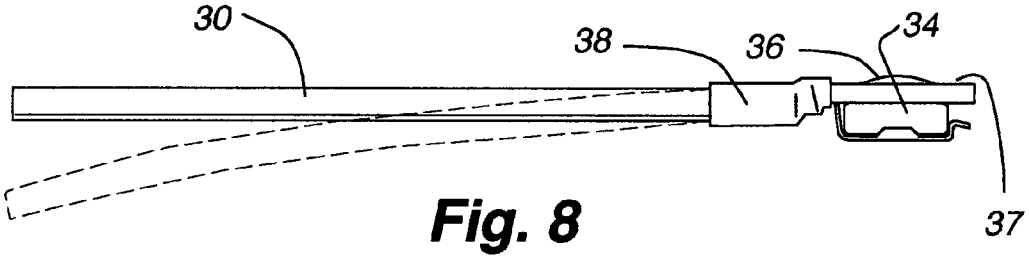
FIG. 8 is a side elevation of the light illuminating system shown in FIG. 6 with a fixed phantom line position being illustrated.
Figure 9:
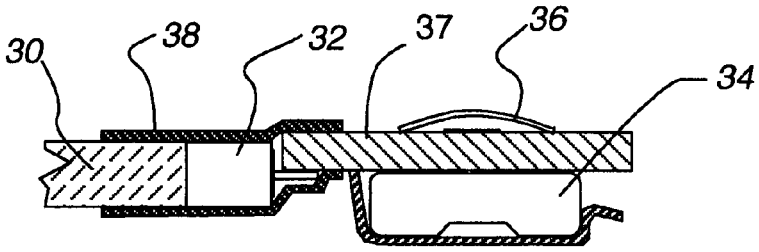
FIG. 9 is an enlarged fragmentary section taken along line 9—9 of FIG. 7.
Figure 10:
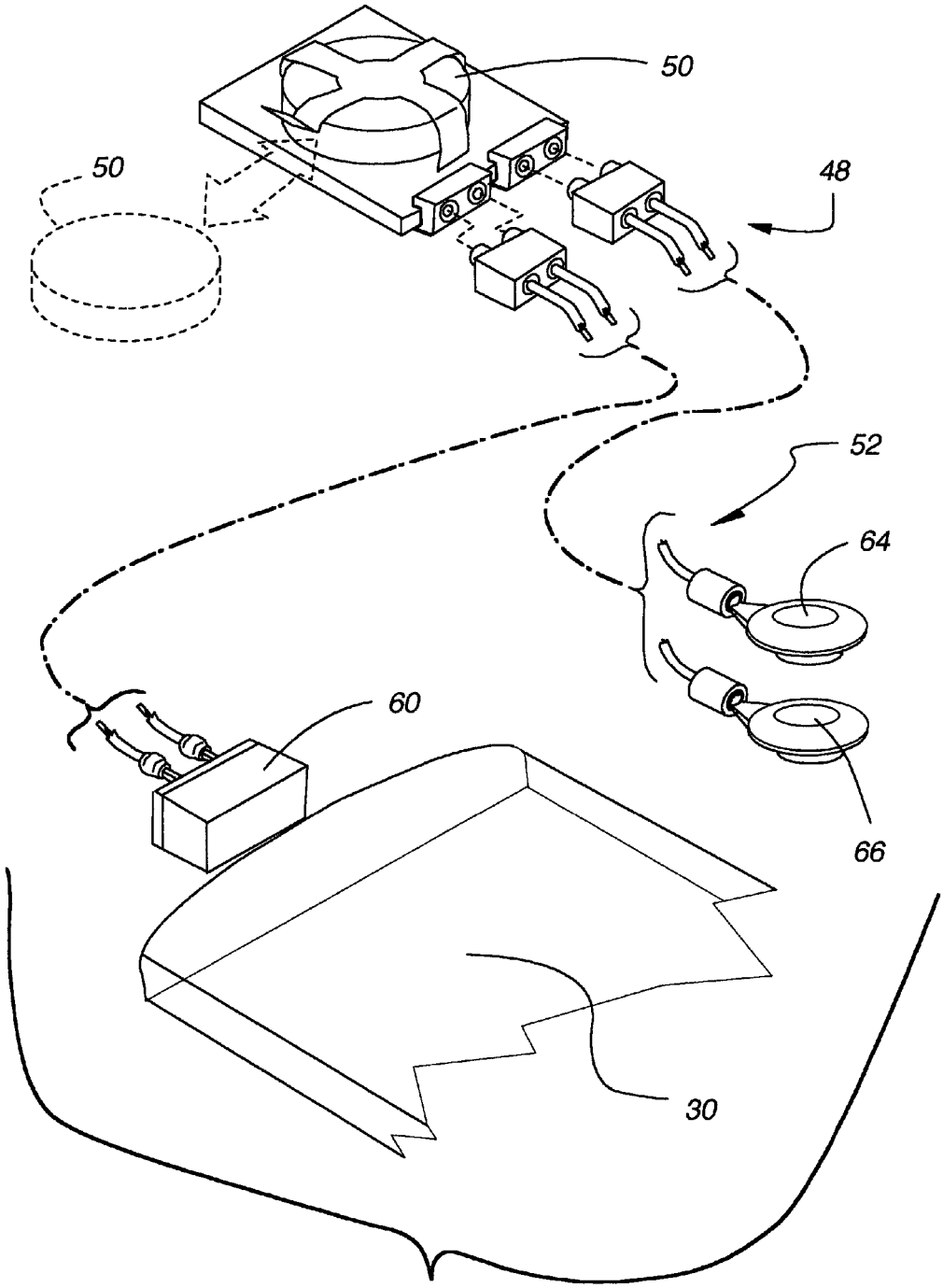
FIG. 10 is a schematic isometric showing the light illuminating source utilized in the glove of FIG. 2.

FIG. 4 illustrates another embodiment 84 of the invention similar to that illustrated in FIG. 3 except the double contact switch 74 is replaced with a dome switch 86 that is removed and positioned at a remote location on the glove, i.e. adjacent to the thumb, from that of the embodiment of FIG. 1.

It will be appreciated from the above that various embodiments of desirably illuminating the back side of an individual's hand have been disclosed for confinement on a glove. They are convenient to operate, distribute light from a small light source across a relatively broad area and do so with circuitry that permits continuous light or blinking light. Further, a remote contact switch having the contacts mounted on the inside of the thumb and index finger for easy activation by simply moving the thumb into engagement with the index finger allows the glove to be operated with a single hand on which the glove is mounted and further, the metal to metal contact is typically sensed by the user of the device so that the user knows when the device has been continuously on, off or in a blinking mode.

Although the present invention has been described with a certain degree of particularity, it is understood that the disclosure has been made by way of example, and changes in detail or structure may be made without departing from the spirit of the invention as defined in the appended claims.

What is claimed is:

1. An illuminated glove comprising in combination, a flexible enclosure for surrounding all or portions of a human hand, said enclosure having an elongated lens formed from a strip of a translucent polymer and a light source positioned thereon for directing light through said lens and illuminating said lens along its length, a battery source and a switch for selectively activating said light source on said enclosure.

2. The glove of claim 1 wherein said light source is contiguous with said elongated lens.

3. The glove of claim 1 wherein said light source is embedded in said elongated lens.

4. The glove of claim 1 wherein said switch is operative to energize said light source in one of two modes of (a) blinking or (b) continuous, and to de-energize said light source.

5. The glove of claim 1 wherein said switch includes contacts to open and close the switch and wherein the contacts are disposed on said enclosure for selective contact by an individual wearing the glove.

6. The glove of claim 5 wherein said switch is operative to energize said light source in one of two modes of (a) blinking or (b) continuous, and to de-energize said light source.

7. The glove of claim 5 wherein said glove includes sleeves for the index finger and thumb of the user and wherein said contacts are on the thumb sleeve and the index finger sleeve of the glove.

* * * * *